United States Patent [19]

Dickinson

[11] 4,241,722

[45] Dec. 30, 1980

[54] POLLUTANT-FREE LOW TEMPERATURE COMBUSTION PROCESS HAVING CARBONACEOUS FUEL SUSPENDED IN ALKALINE AQUEOUS SOLUTION

[76] Inventor: Norman L. Dickinson, Box 211, Lavallette, N.J. 08735

[21] Appl. No.: 947,511

[22] Filed: Oct. 2, 1978

[51] Int. Cl.[3] ..... F23C 7/00

[52] U.S. Cl. ..... 126/263; 122/1 R; 431/11

[58] Field of Search ..... 126/263; 122/1 R; 431/11; 110/218, 229

[56] References Cited

U.S. PATENT DOCUMENTS

| | | | |
|---|---|---|---|
| 3,159,145 | 12/1964 | Strohmeyer | 122/1 R |
| 3,563,226 | 2/1971 | Rockerfeller | 126/263 |
| 3,818,869 | 6/1974 | Blaskowski | 110/229 |
| 4,051,888 | 10/1977 | Yamada | 126/263 |

*Primary Examiner*—Herbert F. Ross

[57] ABSTRACT

A continuous process for the combustion of carbonaceous fuels under conditions such that oxides of nitrogen are not formed and oxides of sulfur and particles of ash are effectively prevented from contaminating the gaseous products released to the atmosphere. Fuel is charged as a slurry in alkaline aqueous solution and contacted with combustion air so that the catalytic properties of both water and alkali operate to permit rapid and complete combustion at unusually low temperatures. Useful heat is extracted from the heated mixture. At the low combustion temperatures, sulfur in the fuel oxidizes to the trioxide which dissolves completely in the alkaline liquid phase which also retains particles of ash and unburned fuel.

20 Claims, 4 Drawing Figures

POLLUTANT-FREE LOW TEMPERATURE COMBUSTION PROCESS HAVING CARBONACEOUS FUEL SUSPENDED IN ALKALINE AQUEOUS SOLUTION

BACKGROUND OF THE INVENTION

This invention concerns the utilization of the heating values of carbonaceous fuels for the production of useful thermal, mechanical or electrical energy.

Burning coal to generate steam is one of the oldest of the industrial arts. Numerous inventions have been applied to improving its efficiency and alleviating the co-production of noxious smoke, which tends to contain unburned fuel, finely powdered ash and oxides of sulfur and nitrogen. Nevertheless, even with the latest technology, coal is considered a dirty fuel, capable only with great difficulty and expense of complying with increasingly stringent air pollution standards.

The high cost of removing sulfur oxides from conventional flue gasses has resulted in a spread between the prices of low and high sulfur coals. Moreover, the former are found, for the most part, in western states remote from the areas of greatest energy need. Thus, the market price structure provides economic incentive for the commercialization of a process able to produce steam and power from high sulfur coals without polluting the atmosphere.

Combustion of coal in conventional ways creates temperatures well above 2000° F. Conventional apparatus must therefore be constructed of expensive materials capable of withstanding such temperatures. Moreover, components of the ash frequently melt (slag) forming deposits which foul parts of the apparatus, causing loss of efficiency, downtime and increased maintenance expense. A further undesirable consequence of the usual combustion temperatures is the inadvertant formation of nitrogen oxides which cannot be effectively and economically removed from flue gas with available technology.

Generation of high pressure steam does not inherently require such high temperatures since the boiling point of water at 2000 pounds per square inch is only about 635° F. and at 3000 pounds per square inch about 695° F.

Some experimental combustion systems, particularly those employing fluidized beds of finely divided solids at elevated pressure, permit combustion in a lower temperature range, typically 1500° to 1700° F. Although nitrogen oxides are thus largely avoided, expensive temperature-resistant construction is still required and new difficulties, associated with the maintenance of fluidized solids properties, erosion and removal of dust from gas streams, are entailed.

It has also been proposed to burn coal without air pollution by the indirect means of first converting it to liquid or gaseous fuel which can be desulfurized before combustion to a clean flue gas. These techniques also employ high temperature and generally share serious economic and operational drawbacks associated with coal's tendency to cake and stick when heated, the formation of tarry residues and difficulties with erosion and dust control. These techniques are further burdened by low overall thermal efficiencies.

It has been known for more than 70 years that liquid water accelerates the reaction between coal and atmospheric oxygen. In 1908, Dr. S. W. Parr (University of Illinois Bulletins 17 and 46) reported, "The presence of moisture increases the chemical reactivity of the coal-air system at any temperature." The quantitative effect for various coals has been extensively documented over the years. Ordinary combustion processes cannot take advantage of this phenomenon because wet coal must be dried before it will ignite.

Likewise, the catalytic effect of common alkalis such as soda ash (sodium carbonate) and limestone (calcium carbonate) on the reactivity of carbonaceous materials is well known and has been utilized in the gasification of coal and coke. Alkaline compounds are also used in commercial steam-hydrocarbon reforming catalysts to prevent carbon buildup by speeding up its oxidation to gaseous products. Conventional combustion processes do not employ alkaline catalysts because at the high temperatures they would volatilize and/or combine with ash ingredients to form troublesome slag or clinker.

SUMMARY OF THE INVENTION

Carbonaceous fuel is ground or pulverized, charged as a slurry in alkaline aqueous solution and contacted with air at elevated temperature and pressure sufficient to maintain the solution substantially in liquid phase. The catalytic properties of both water and alkali operate to permit essentially complete combustion within a temperature range in which there is negligible formation of nitrogen oxides; ash particles remain suspended in the solution and sulfur is oxidized to the trioxide which dissolves in the alkaline solution thereby producing a flue gas substantially clean and free from pollutants.

Reaction temperature is controlled at the desired level by removing the net heat of combustion either by flash cooling a recycled stream of slurry or by removing heat from it by indirect transfer to boiling feedwater or other heat transfer fluid, or by a combination of both methods. Useful energy contained in the steam from flashing the slurry and/or generated by indirect transfer and/or contained in other reactor cooling fluid comprises the desired product of the process.

Solution containing suspended ash is removed from the reaction zone at a rate such that buildup of ash and soluble impurities is avoided.

An object of this invention is to provide a practical and economical means of obtaining heat and power from coal and other carbonaceous fuels without polluting the atmosphere. Another object is to make it economically possible to utilize reserves of fuels with high contents of sulfur, ash, water or other contaminants which are poorly suited to conventional combustion methods.

DESCRIPTION OF PREFERRED EMBODIMENTS

Figure 1:
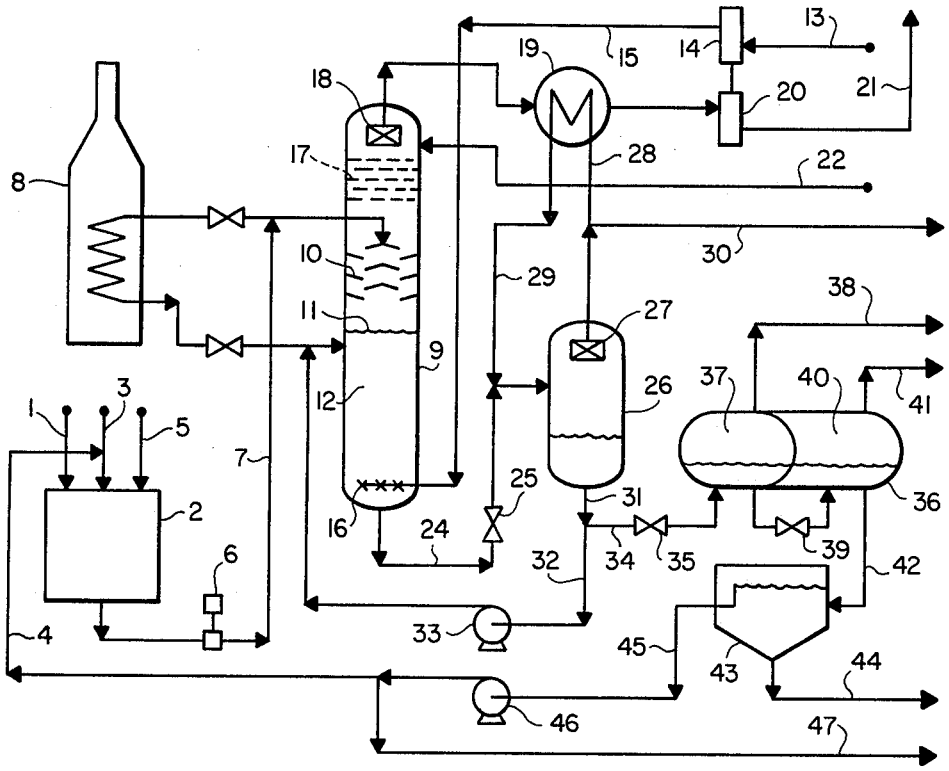
FIG. 1 is a schematic elevational diagram illustrating a simple embodiment of the process of the invention using slurry flashing for steam generation.

With reference to FIG. 1, a carbonaceous fuel such as crushed coal is supplied through a conduit 1 to a conventional grinding and slurrying system 2 in which it is mixed with feed-water coming from a suitable storage facility through a line 3 and recycled solution entering by means of a line 4. Powdered, granular, dissolved or slurried alkali is added to the mixture via a conduit 5. A coal slurry charge pump 6 draws the resulting slurry from the grinding and slurrying system 2 and provides sufficient pressure to cause the slurry to flow by means of a line 7 either through a start-up heater 8, used while bringing the apparatus on-stream, or directly into a feed preheat section of a reactor 9.

Referring to the reactor 9, the charge slurry is first preheated by counter-current vapor-slurry contact with a flue gas-steam mixture flowing upward from a reaction section 12 within the reactor 9. In the course of this contact, which is effected by baffles 10, a substantial portion of the steam in the entering gaseous mixture is condensed to water thereby diluting and heating the slurry prior to its entry into the reaction zone 12 at an interface 11. Additional dilution is provided by water flowing downward from a cooling and washing section 17.

Referring to the section 17 of the reactor 9, the cooling and washing section 17 is equipped with perforated trays, or the equivalent, and utilizes water entering by means of a line 22 to further cool and condense additional steam from the flue gas as well as to wash it free from entrained slurry. Flue gas passes from the section 17 through a mist extractor 18 and is freed of entrained water droplets before being superheated by indirect exchange with condensing steam in a heat exchanger 19. Potential energy in the flue gas by virtue of its pressure and temperature is then recovered by expanding it to essentially atmospheric pressure in a turbine 20. It is to be understood that the exchanger 19 and the turbine 20 may, in fact, represent a plurality of such pairs of equipment arranged in series.

An air compressor 14 is coupled to the turbine 20. Filtered atmospheric air passes via a conduit 13 to the inlet of the air compressor 14 which may, in practice, comprise a plurality of machines in series with intercoolers of conventional design, not shown, between machines. In such case, make-up water in the line 22 would be used as the cooling medium so as to conserve the heat removed from the interstage air. The compressed air is delivered through a line 15 to the lower part of the reactor 9 into which it is dispersed by means of a distributor 16.

The air distributed in the lower part of the reactor 9 bubbles upward through the reaction section 12 in which the slurry of powdered coal and ash comprises the continuous phase. As the bubbles rise they become saturated with water vapor and the oxygen contained in them reacts with the coal particles to form carbon dioxide and water. Sulfur in the coal particles also reacts with a portion of the oxygen to form sulfur trioxide which, because of the extreme solubility of this compound, does not enter the gaseous phase, but dissolves in the liquid portion of the slurry.

In order to control the temperature of the slurry in the reaction section 12, it is necessary to continually remove most of the heat of reaction (combustion). In the embodiment of FIG.1, a stream of slurry flows through a line 24 coupled to the lower portion of the reactor 9, under control of a pressure reducing valve 25, to a main flash drum 26 whose pressure is maintained at a level lower than that of the reactor 9. The reduction of pressure at the valve 25 causes part of the water in the slurry to vaporize, producing steam which is separated from slurry phase in the flash drum 26 and further freed of entrained droplets by a mist extractor 27. A portion of this steam flows via a line 28 to the heat exchanger 19, in which the steam condenses and returns as liquid water to the flash drum 26 through a line 29.

The remainder of the steam from the mist extractor 27 leaves the apparatus through a line 30 as the main product of the process.

The slurry remaining in the flash drum 26 after separation of the steam now contains less water than before the flashing and has been cooled by the withdrawal of latent heat of the water converted to steam. This cooled slurry leaves the flash drum 26 by means of a line 31 and then divides into two streams. The larger of the streams flows via a line 32 to a slurry recycle pump 33 which provides an increase in pressure sufficient to return it to the reactor 9 where the absorption of heat necessary to reheat it to the temperature of the reaction zone 12 provides the cooling needed to control the reaction temperature.

The other portion of slurry, withdrawn through a line 34, comprises the means by which product ash and soluble by-products are removed from the reaction system. In the example of FIG. 1, it flows via a pressure reducing valve 35 to a medium pressure section 37 of an ash slurry flash drum 36, which is held at a pressure intermediate between that of the main flash drum 26 and atmospheric pressure. This second pressure reduction also causes steam to separate and the unvaporized slurry to be further cooled. Medium pressure steam leaves the medium pressure section 37 via a conduit 38 and may be used for any heating or auxiliary purpose for which it is suitable, such as preheating, by means of apparatus not shown, feedwater in the line 3 or coal slurry in the line 7.

Similarly, ash slurry from the medium pressure section 37 of the ash slurry flash drum 36 flows via a pressure reducing valve 39 to a low pressure section 40 of the ash slurry flash drum 36. Additional flashing produces low pressure steam sent via a conduit 41 to some use for which it is suitable while the residual slurry, now only slightly above its atmospheric boiling point, is removed through a line 42 to a settler 43. While two stages of ash slurry flashing are shown in this illustration, it is to be understood that a single stage, or more than two stages, may be employed in practice, depending upon coal properties and local process economics.

Referring to the settler 43, gravity causes particles of ash to concentrate in the conical bottom section from which they are removed for disposal through a conduit 44. The liquid portion, from which most of the ash has been separated, is taken via a line 45 from the top of the settler 43 to a solution recycle pump 46 which causes it to flow to a point of division between a portion which is purged from the apparatus via a line 47 and a portion which is recycled through the line 4 to the grinding and slurrying system 2 and thence to the reactor 9.

An advantage of the process of FIG. 1 is that product steam is produced by flashing, rather than by heat transfer across boiler tubes subject to scaling or fouling. Therefore, it is unnecessary to purify the feedwater to the system. A corresponding disadvantage may be that the flash steam contains too many impurities to be suitable for large central station turbo-generators, although it is satisfactory for heating or evaporating services requiring steam of its pressure.

Figure 2:
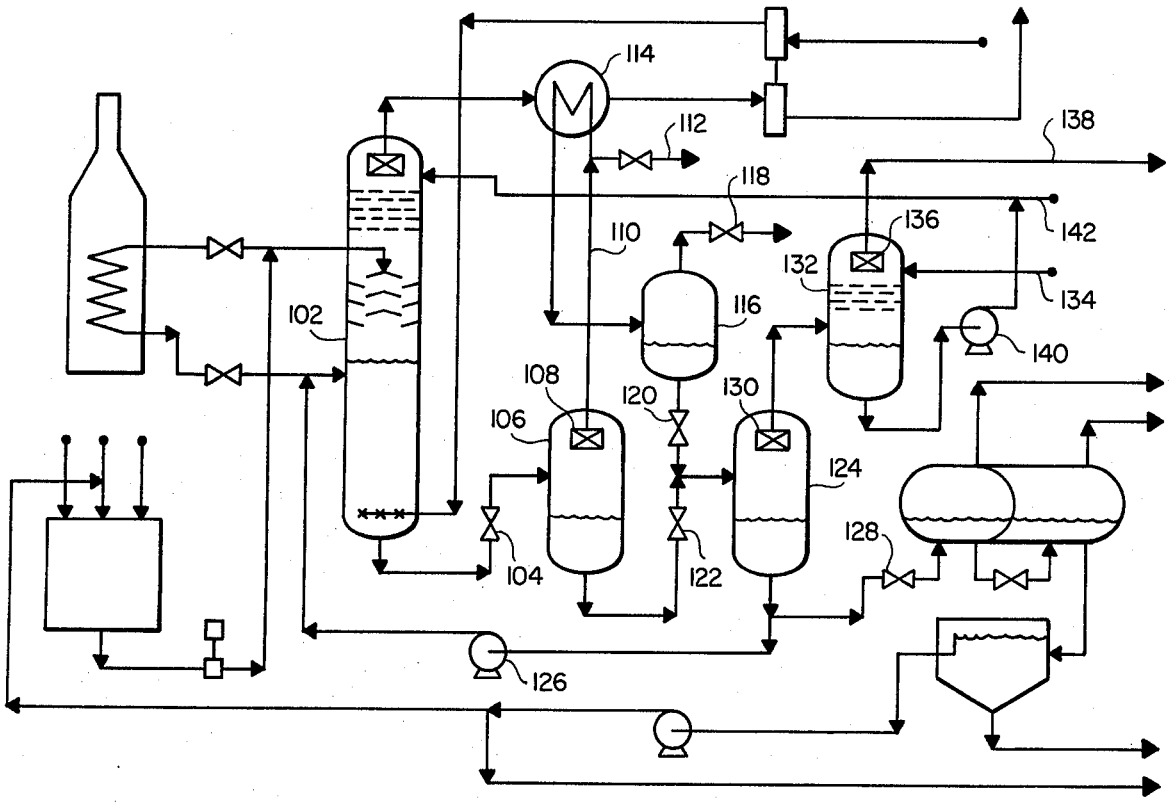
FIG. 2 is a schematic elevational diagram illustrating an embodiment similar to that of FIG. 1 with double flashing of slurry and steam washing.

Referring to FIG. 2, a schematic diagram similar to that of FIG. 1, but including, in addition, double flashing of ash slurry and steam washing is shown. Features of particular interest are the double flashing of ash slurry by flash drums 106 and 124 which produce steam at two different pressure levels, and the washing of product steam with hot condensate in steam washer 132. A disadvantage of producing steam in the system of FIG. 1 by a single flash is that gases dissolved and/or entrained in the slurry leaving the reactor carry over into the steam. By subjecting the slurry to a preliminary flash ("pre-flash"), as in the example of FIG. 2, gaseous impurities may be stripped out before they can contaminate the product steam.

The pressure of a first, or pre-flash, drum 106 is regulated so that the amount of steam vaporized and separated in it is only sufficient for heating functions internal to the installation. In FIG. 2, this contaminated steam is shown supplying heat for preheating flue gas in a heat exchanger 114. A connection 112 is shown by means of which this steam may also be sent to other heating services, such as reheating flue gas and product steam between turbine stages.

Steam condensate from the heat exchanger 114 along with the fixed gases which accompany it, is shown to be collected in a pre-flash condensate drum 116 from which the gas-free condensate flows via a control valve 120 to a main flash drum 124. The gases are vented via a valve 118 to atmosphere or an interstage connection in the flue gas turbine train.

Referring again to the pre-flash drum 106, the pre-flashed slurry, now essentially free of fixed gases, flows from the bottom of the drum via a second pressure control valve 122 to the main flash drum 124, maintained at a further reduced pressure. This second pressure reduction results in the vaporization of additional slurry water, generating product steam.

Since the slurry from which the product steam is separated contains a high concentration of dissolved solids, the steam is still subject to contamination with entrained or volatilized solids, principally silica, liable to cause fouling of the blades of steam turbines. Therefore, after being freed of most of the entrained droplets of slurry in a mist extractor 130, the steam flows to a steam washer 132 in which it rises through a series of contact elements, such as perforated plates, while being washed by a downward flowing stream of hot, pure condensate, which enters via a line 134. Purified steam leaves the apparatus via a mist extractor 136 and a line 138. The wash condensate will have been preheated by exchange with available heat sources in equipment not shown.

After performing the washing service, the condensate collecting in the bottom of the steam washer 132 is pumped by a condensate pump 140 to join water entering the apparatus by means of a line 142. The combined stream then flowing as water make-up, as in the embodiment of FIG. 1, to the top of the reactor 102.

Figure 3:
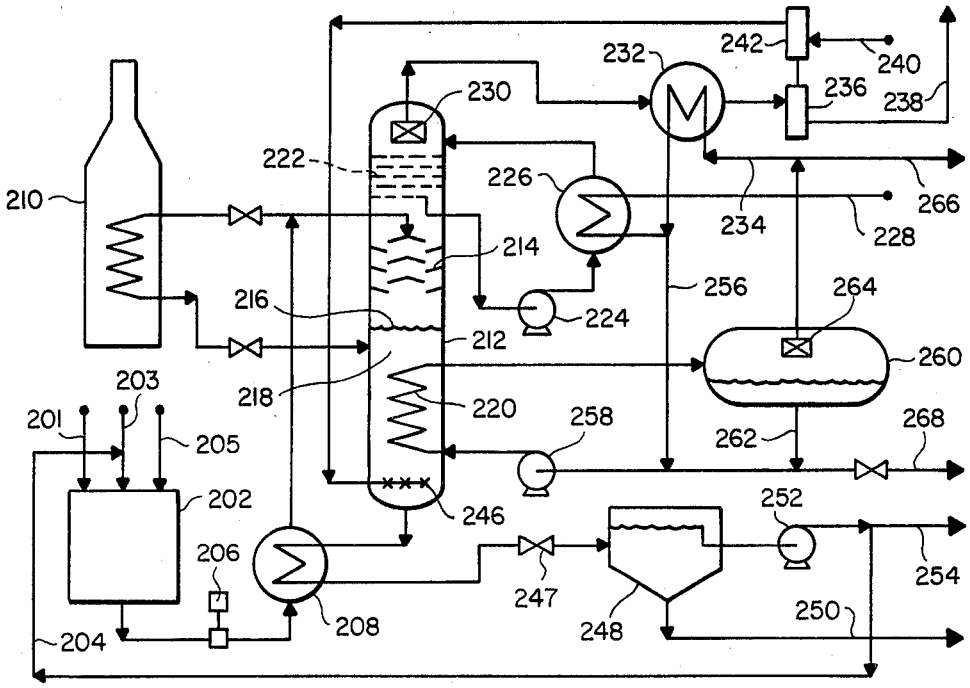
FIG. 3 is a schematic elevational diagram illustrating an embodiment in which the generation of steam is by heat exchange with the slurry.

The embodiment of FIG. 3 is distinguished from those of FIGS. 1 and 2 by the use of indirect heat exchange, in place of slurry flashing, for the extraction of combustion heat. With reference to FIG. 3, carbonaceous fuel such as crushed coal is supplied through a conduit 201 to a conventional grinding and slurrying system 202 in which it is mixed with feedwater coming from a suitable storage facility through a line 203 and recycled solution entering by means of a line 204. Powdered, granular, dissolved or slurried alkali is added to the mixture via a conduit 205. A coal slurry charge pump 206 draws the resulting slurry from the grinding and slurrying system 202 and provides sufficient pressure to cause the slurry to flow through an ash slurry to coal slurry heat exchanger 208, either through a start-up heater 210, used while bringing the apparatus on-stream, or directly into a feed preheat section of a reactor 212.

In the reactor 212, the charge slurry is first preheated by counter-current vapor-slurry contact with a flue gas-steam mixture flowing upward from a reaction section 218. In the course of this contact, which is effected by baffles 214, a portion of the steam in the rising gaseous mixture is condensed to water thereby diluting and heating the slurry prior to its entry into the reaction zone 218 at an interface 216. Additional dilution is provided by water flowing downward from a cooling and washing section 222.

Referring to the section 222 of the reactor 212, the cooling and washing section 222 is equipped with perforated trays, or the equivalent, and utilizes a stream of water recirculated by a circulating reflux pump 224 through a circulating reflux-boiler feedwater exchanger 226 to further cool and condense additional steam from the flue gas, as well as to wash it free from entrained slurry. Flue gas passes from the section 222 through a mist extractor 230 in which it is freed of entrained water droplets before being heated by indirect exchange with condensing steam in a heat exchanger 232. Potential energy in the flue gas by virtue of its pressure and temperature is then recovered by expanding it to essentially atmospheric pressure in a turbine 236 for discharge through a vent line 238. The exchanger 232 and the turbine 236 may, in fact, represent a plurality of such pairs of equipment arranged in series.

An air compressor 242 is coupled to, and receives power from, the turbine 236. Filtered atmospheric air passes via a conduit 240 to the inlet of the air compressor 242 which may, in practice, comprise a plurality of machines in series with intercoolers of conventional design (not shown) between machines. The compressed air is delivered to an air distributor 246 located near the bottom of the reactor 212, which disperses it into the lower part of the column of slurry in the reaction section 218.

The dispersed air bubbles upward through the reaction section 218 in which the slurry of powdered coal and ash comprises the continuous phase. As the bubbles rise, they become saturated with water vapor and the oxygen contained in them reacts with coal particles to form carbon dioxide and water. Sulfur in the coal particles also reacts with a portion of the oxygen to form sulfur trioxide which, because of the extreme solubility of this compound, does not enter the gaseous phase, but dissolves in the liquid portion of the slurry.

In order to control the temperature of the slurry in the reaction section 218, it is necessary to continually remove most of the heat of reaction (combustion). In the embodiment of FIG. 3, this heat is transferred through the surface of a heat exchanger coil 220 immersed in the slurry of the reaction zone 218. The coolant inside the coil 220 is boiling water which is supplied by a boiler feedwater circulating pump 258.

Condensate from the condensers of conventional turbines utilizing the product steam from the apparatus supplemented, as required, by treated boiler feedwater, is supplied from offsite through a line 228 and may be first preheated by hot compressed air in the intercoolers (not shown) of the air compressor 242. Additional heat is provided to the feedwater in the line 228 by circulating reflux in the heat exchanger 226. The heated boiler feedwater is then joined by the steam condensate leaving the flue gas heat exchanger 232 before flowing via a line 256 as the combined make-up water to the suction of the boiler feedwater circulating pump 258.

Leaving the reactor heat exchanger coil 220 is a mixture of water and steam, the latter carrying as latent heat of evaporation the reaction heat extracted from the slurry in the reaction section 218. The water-steam mixture is separated in a steam drum 260 from which the water returns to the boiler feedwater circulating pump 258. The steam is freed of entrained water droplets in a mist extractor 264 and then divides, a portion flowing via a line 234 to the flue gas heat exchanger 232 and the remainder via a line 266 to the limits of the apparatus as the main product of the process.

A slurry of ash particles flows from the bottom connection of the reactor 212, under control of a pressure reducing valve 247. The ash slurry first gives up sensible heat to incoming coal slurry in the heat exchanger 208 before being reduced to atmospheric pressure as it enters an ash settler 248. In the settler 248, gravity causes particles of ash to concentrate in the conical bottom from which they are removed for disposal through a conduit 250. Clarified solution, from which most of the ash has been settled, is drawn from the top of the settler by a solution recycle pump 252 which moves it to a point of division between that portion which is recycled through the line 204 to the coal grinding and slurrying system, and that portion which is purged from the apparatus via a line 254 as a means of disposing of sulfur and soluble impurities which entered with the coal.

It is not necessary that the heat transfer surface used to control reaction zone temperature as exemplified in FIG. 3 by the heat exchanger coil 220, be within the reaction zone. The heated reaction zone slurry may be recirculated through a heat exchanger external to the reactor.

Since, in the embodiment of FIG. 3, boiler feedwater and product steam do not come in contact with coal or flue gas, the product steam is of as high a purity as it would be from a conventional boiler plant operating with the same feedwater.

Figure 4:
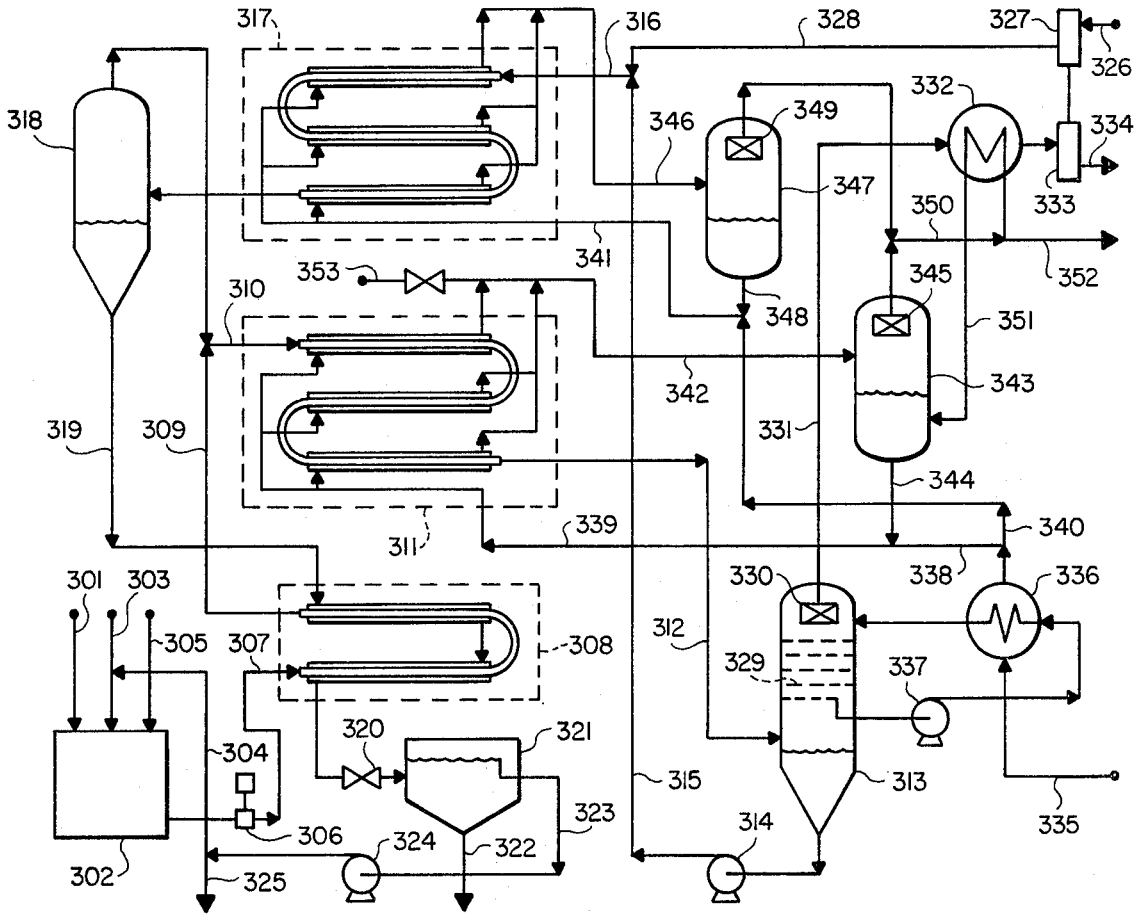
FIG. 4 is a schematic elevational diagram illustrating an embodiment in which the generation of steam is by heat transfer with a two-stage concurrent reaction system.

Several of the equipment items utilized in the process of the invention, such as heat exchangers, slurry pumps, reactors, liquid-solids separators, etc. are subject to considerable variation in type and configuration. Referring to FIG. 4, a diagrammatic elevational view of an alternative arrangement of equipment items illustrating some of these variations as well as producing steam of a quality suitable for large turbo-generators is shown. Referring to FIG. 4, crushed coal from a suitable source is supplied through a conduit 301 to a conventional grinding and slurrying system 302 in which it is mixed with feedwater coming from a suitable storage facility through a line 303 and recycled solution entering by means of a line 304. Powdered, granular, dissolved or slurried alkali is added to the mixture via a conduit 305. A coal slurry charge pump 306 draws the resulting slurry from the grinding and slurrying system 302 and provides sufficient pressure to cause the slurry to flow by way of a line 307 through a preheat exchanger 308 through lines 309 and 310 and to the inlet of a first stage reactor 311. The exchanger 308, which is illustrated as, but is not necessarily of, double pipe type, preheats the feed slurry by indirect exchange with hot ash slurry leaving the reaction system via a line 319 from a second stage separator 318.

The preheated slurry, after passing through the line 309, mixes with partially exhausted air from the second stage separator 318. The mixture then flows through the line 310 to the inlet of the reactor 311.

The reactor 311 consists essentially of a double pipe heat exchanger similar to many used conventionally in various process industries except that its elements are carefully sized to provide suitable velocity and residence time for the reaction in the inner pipe and sufficient heat transfer surface to remove the released heat with the desired temperature difference between the hot slurry in the inner pipe and boiling water in the outer pipe. A mixture of flue gas and slurry of partially burned coal leave the reactor 311 via a line 312 and is separated into its respective phases in a first stage separator 313. Slurry phase is delivered by a pump 314 from the bottom of the separator 313 via a line 315 to a point of mixing with incoming combustion air from a line 328. The mixture flows to the inlet of a second stage reactor 317 by means of a line 316.

The reactor 317 also consists essentially of a double pipe heat exchanger with elements sized according to criteria similar to those for the reactor 311. The illustration of three double pipe elements in series for the reactors 311 and 317 is diagrammatic; on the commercial scale considerably larger numbers of elements are necessary, arranged both in series and parallel. Also, the flow of reactants may be upward rather than downward, or upward in some banks of double pipes, downward in others.

The effluent from the reactor 317 is a mixture of partially exhausted air and ash slurry which flows to the second stage separator 318 in which it is separated into its respective phases. The gas phase, as previously described, goes to the inlet of the reactor 311 while, from the bottom of the separator 318, the ash slurry flows, as previously described, through the preheat exchanger 308 in which it is cooled by indirect exchange with cold incoming coal slurry. The cooled slurry then leaves the zone of elevated pressure by passing through a pressure control valve 320 and entering an ash settler 321.

In the case of a coal which is difficult to burn completely, part of the hot ash slurry in the line 319 may be recycled through the reaction system by means of lines and a pump (not shown) connecting the line 319 and the line 309.

Referring to the settler 321, gravity causes particles of ash to concentrate in the conical bottom section from which they are removed from disposal through a conduit 322. The liquid portion, from which most of the ash has been separated, is taken from the top of the settler 321 via a line 323 to a solution recycle pump 324 which causes it to flow to a point of division between that portion which will be purged from the apparatus via a line 325 and that portion which will be recycled through the line 304.

Referring to the upper right hand portion of FIG. 4, filtered air enters the apparatus via a conduit 326 and is compressed in an air compressor 327 which may, in practice, comprise a plurality of machines in series with inter-coolers of conventional design, not shown, between machines and is delivered through the line 328 to a mixing point with partially burned coal slurry coming, as previously described, from the line 315.

Referring to the lower right portion of FIG. 4, and the separator 313, flue gas saturated with water vapor separated in the first stage separator 313 flows upward through a rectification zone equipped with counter-current vapor-liquid contacting elements 329, such as perforated plates, in which it is cooled and washed by a water stream circulated by a pump 337. The circulating water also serves to condense a substantial portion of the water vapor contained in the flue gas which leaves the separator 313 through a mist extractor 330. Cooled and partially dried flue gas flows from the mist extractor 330 through a line 331 to a heat exchanger 332 in which it is superheated by indirect exchange with condensing high pressure steam before entering a flue gas expansion turbine 333. In some cases, an additional heat exchanger (not shown) may be positioned in the line 331 in which the flue gas is preheated by exchange with a portion of the hot water circulated by the pump 337.

It is to be understood that the flue gas heat exchanger 332 and the turbine 333 may, in fact, represent a plurality of such pairs of equipment arranged in series. Upon leaving the turbine 333 (or the last of a series of such turbines) the flue gas will be essentially at atmospheric pressure and may be discharged to the atmosphere through a vent 334.

The turbine 333 is mechanically coupled with, and delivers power to, the air compressor 327. If, in practice, a plurality of compressor machines are employed, then the same number of turbines are preferably each coupled with its corresponding compressor. Moreover, a steam turbine or an electric motor, or both, may also be coupled with one or more of the turbine-compressor sets for bringing the unit on-stream or achieving a precise power balance during normal operation.

Referring to the lower right portion of FIG. 4, condensate from the condensers of conventional turbo-generators utilizing the high pressure steam from the illustrated apparatus supplemented, as required, by treated boiler feedwater and pumped by a conventional boiler feedwater pump (not shown), enters a apparatus by means of the line 335 and is preheated in a heat exchanger 336 by indirect exchange with hot water circulated, as previously described, by the pump 337. If intercoolers are used between stages of the air compressor 327, as discussed previously, boiler feedwater in the line 335 would first be used as the cooling medium for the interstage air before being further heated in the heat exchanger 336.

The preheated boiler feedwater stream then divides, part going by a line 338 to the cooling system of the first stage reactor 311 and the remainder by a line 340 to the cooling system of the second stage reactor 317. The feedwater from the line 338 is joined by recirculating water from a line 344, the combined stream comprising the coolant supplied via a line 339 to the outer pipes of the double pipe reactor 311. Heat transferred from the reacting mixture in the inner pipe converts a substantial part of the supplied feedwater to steam which, along with unvaporized water, is transferred via a line 342 to a first stage steam drum 343. In this drum, a separation is performed between the water, which recirculates through the line 344, and steam, which is dried in a mist extractor 345 before joining in a line 350 the steam similarly produced in the cooling system of the reactor 317.

The corresponding items of the second stage reactor cooling system are the line 341, the outer pipes of the reactor, a line 346, a second stage steam drum 347 and a mist extractor 349. To avoid accumulation of dissolved solids in the water recirculating from the drums 343 and 347 through the lines 344 and 348, respectively, a small amount of water (called "blow-down") is continuously or intermittently withdrawn from the system via connections not shown.

A portion of the steam in the line 350 is diverted to the flue gas superheater 332 in which it is condensed, the condensate rejoining cooling system feedwater by means of a line 351. The net production of high pressure steam leaves the apparatus by means of a line 352.

Referring to a line 353 located in FIG. 4 between the first stage reactor 311 and the second stage reactor 314, it is necessary to bring the feed slurry in one of the reaction stages to a temperature high enough that the combustion reaction will commence in order to place the apparatus in operation from a cold start. This is conveniently accomplished by temporarily bringing in steam from an external source such as through the line 353.

DESCRIPTION OF THE INVENTION

In practicing the process of the invention, coal is ordinarily received, stored, conveyed and crushed in ways familiar to the thermal power industry. It may also be pulverized in grinding mills similar to those used for preparing fuel for conventional powdered coal burners. However, in many cases, it is more convenient to employ some of the known wet grinding techniques, using water and/or recycled solution as the liquid medium. The process of the invention is particularly advantageous when coal is conveyed to the site by coal slurry pipeline because it does not need to be dewatered and dried, but may be charged to the process with no further preparation.

Usually, recycled solution supplies most of the liquid needed to make up the charge slurry. Water is added (if not already present with the fuel) as required to make up a slurry which flows and pumps without difficulty. Water from almost any source is suitable—it does not require special purification. The minimum amount of slurry water (recycled plus make-up) depends upon the physical properties of the coal and may be as low as 50 weight percent. However, there is little economy in minimizing the slurry water and, ordinarily, 60 percent or more will be used.

Alkali is added to the coal slurry as a combustion catalyst and to neutralize the acids (principally sulfuric) formed during the combustion. The amount need only be a slight excess over that needed for neutralization which is, of course, a function of the sulfur content of a particular coal charged.

For convenience in the description of the process of the invention, I have referred to carbonaceous fuels as coal. It is to be understood, however, that it applies similarly to any solid or semi-solid combustible material including, but not limited to, petroleum coke, char, lignite, waste wood products and fuels of vegetable or organic origin known collectively as "biomass".

The alkalized charge slurry is pumped to the pressure of the reaction system with special slurry pumps similar to those developed to charge coal slurry pipelines.

Contact with combustion air takes place in one of several types of reaction systems. FIGS. 1 and 2 illustrate a simple type of counter-current reaction system consisting of a vertical cylindrical section, free of internals excepting a distributor for incoming air. The contact between phases can be improved by the use of mechanical agitation. Counter-current reactor staging may be employed by inserting partitions between sections of the reaction space, arranged so the respective phases can proceed but one way from stage to stage, and in opposite directions. A reactor of several effective stages may be constructed within a single pressure shell in the manner of a "slurry bubble tower" or by directing the phases in their respective directions with a suitable series of baffles.

It is not necessary that all of the stages of a counter-current reaction system operate at the same temperature. In fact, it may be advantageous, from a carbon conversion standpoint, to operate "lower" stages (i.e., nearer to the point of withdrawal of ash slurry) at a higher temperature than "upper" stages (i.e., nearer to the point of admission of coal slurry).

FIG. 4 illustrates a two-stage concurrent type of reaction system. By concurrent I mean that air and slurry flow through any one stage in the same direction. Nevertheless, the flow between stages in counter-current. Therefore, one reactor is a first stage with respect to the coal slurry but a second stage with respect to the air, whereas the other reactor is a second stage with respect to the coal and a first stage with respect to the air. A single stage or more than two stages may be used.

The reaction system illustrated in FIG. 4 is also more or less isothermal (constant temperature) in that heat liberation and cooling occur simultaneously.

The temperature necessary for a practical rate of combustion depends somewhat on the natural reactivity (rank) of the fuel. Lignite, for example, being more reactive than anthracite, does not require as high reaction temperature. Certain configurations of reactors, such as those with more stages, do not require as high a temperature as simpler reaction systems. However, in general, the preferred operating temperature range is from about 550 to about 705° F. The corresponding operating pressure range is from about 2000 to about 10,000 pounds per square inch.

Reaction temperature may be regulated at a level higher than required by reaction rate considerations in order to make the product heat available at a higher (more useful) level as, for example, to generate steam of higher pressure.

After completion of the combustion and the transfer of the net heat production to a heat transfer medium (such as water/steam) flue gas is separated from ash slurry by means of one of the known vapor-liquid separating techniques. Flue gas is then subjected to power recovery in gas tubrines of conventional design. Some of the hot separated ash slurry may be recycled to the reaction system as a means of minimizing unconverted carbon. The net ash slurry is cooled and separated by means of conventional liquid-solids separating techniques into wet ash, which leaves the system for disposal, and a solution containing excess alkali, alkali sulfate and various salts dissolved from the fuel.

All of the solution separated from the ash may be discarded. However, normally part is recycled to the fuel feed slurrying system and part purged from the system. The purpose of the purge is to reject essentially all of the soluble impurities from the system. A purpose of the recycle stream is to build up the concentration of these soluble materials so that a relatively small volume of purge will suffice to remove them at an equilibrium rate.

When soda ash is the alkali added to the feed slurry, the salts which form in the reaction system as well as those extracted from the coil ordinarily remain in liquid phase and are purged from the solution recycle. However, when less soluble alkalis, such as limestone, are employed complexes and/or hydrates may remain or become of solid state and be removed along with the ash.

Water soluble salts purged when soda ash is used may represent a disposal problem and therefore may be treated with lime or limestone externally to the system to convert them into comparatively insoluble calcium salts, regenerating the soda ash solution for re-use. This treatment uses technology known to so-called "double alkali" processes for scrubbing conventional flue gasses.

The power consumed in compressing combustion air is considerable, but is offset by the power available from expansion of the flue gas, which may be augmented by increasing its volume by control of water vapor content and temperature. It is logical to couple the expansion turbines directly to the air compressors. In this respect, the process resembles conventional flue gas turbine sets, with the slurry combustion system replacing the conventional combustion chambers, but the net energy output is from the slurry combustion system, rather than from the turbine shafts.

Having described my invention I claim:

1. A process for converting the heating value of a carbonaceous fuel to useful energy comprising the steps of:
   - grinding the fuel to form fuel particles;
   - mixing the fuel particles with an alkaline aqueous fluid to form a fuel slurry;
   - contacting the fuel slurry with air in a reaction zone the temperature and pressure of which are such as to cause a combustible portion of the fuel particles to burn while a portion of the aqueous fluid remains in liquid phase; and
   - extracting useful heat from the reaction zone.

2. A process as in claim 1 in which the step of contacting the fuel slurry with air includes the steps of:
   - charging the fuel slurry to a reaction zone in which a mixed slurry of combustible and non-combustible particles comprises a continuous phase; and
   - distributing the air in the lower part of the reaction zone so that it bubbles upward as a gaseous phase through the continuous slurry phase.

3. A process as in claim 2 in which the contact between the mixed slurry and the air is enhanced by mechanical agitation.

4. A process as in claim 2 in which there are a plurality of reaction zones arranged so that the flow of the slurry phase between the reaction zones is counter-current to the flow of the gaseous phase between the reaction zones.

5. A process as in claim 2 in which the step of extracting useful heat includes the steps of:
   - withdrawing a stream of the mixed slurry from the reaction zone to a zone of reduced pressure, causing some of the water contained therein to vaporize, forming steam;
   - separating the steam from unvaporized slurry; and
   - returning a portion of the unvaporized slurry to the reaction zone.

6. A process as in claim 2 in which the step of extracting useful heat includes the steps of:
withdrawing a stream of the mixed slurry from the reaction zone to a zone of reduced pressure, causing some of the water contained therein to vaporize, forming primary steam;
separating the primary steam from unvaporized slurry;
subjecting the unvaporized slurry to a second reduction in pressure causing additional water contained therein to vaporize, forming secondary steam;
separating the secondary steam from slurry remaining unvaporized; and
returning a portion of the slurry remaining unvaporized to the reaction zone.

7. A process as in claim 2 in which the step of extracting useful heat from the reaction zone includes transferring the useful heat through heat exchange surface to a heat transfer medium.

8. A process as in claim 7 in which the heat transfer medium is boiling water.

9. A process as in claim 5 and including the additional steps of:
cooling a portion of the unvaporized slurry;
reducing the pressure of the cooled slurry to a pressure near atmospheric;
separating the cooled and depressurized slurry into liquid and solid components; and
utilizing a portion of the liquid component as an ingredient of the alkaline aqueous fluid.

10. A process as in claim 6 and including the additional steps of:
cooling a portion of the slurry remaining unvaporized;
reducing the pressure of the cooled slurry to a pressure near atmospheric;
separating the cooled and depressurized slurry into liquid and solid components; and
utilizing a portion of the liquid component as an ingredient of the alkaline aqueous fluid.

11. A process as in claim 1 in which the step of contacting the fuel slurry with air includes the steps of:
mixing the fuel slurry with the air;
causing the mixture to flow through an elongated reaction zone in which the temperature is regulated by transfer of heat through heat exchange surface to a heat transfer medium; and
separating the effluent of the reaction zone into slurry and gaseous phases.

12. A process as in claim 11 in which the heat transfer medium is boiling water.

13. A process as in claim 1 in which the step of contacting the fuel slurry with air includes the steps of:
mixing the fuel slurry with partially exhausted air;
causing the mixture of fuel slurry and partially exhausted air to flow through a first elongated reaction zone in which the temperature is regulated by transfer of heat through heat exchange surface to a first heat transfer medium;
separating the effluent of the first reaction zone into slurry and gaseous phases;
mixing the slurry from the first reaction zone with the air;
causing the mixture of the first reaction zone slurry and air to flow through a second elongated reaction zone in which the temperature is regulated by transfer of heat through heat exchange surface to a second heat transfer medium; and
separating the effluent of the second reaction zone into a slurry phase and a gaseous phase comprising the partially exhausted air.

14. A process as in claim 13 in which the first heat transfer medium and the second heat transfer medium are boiling water.

15. A process as in claim 11 and including the additional steps of:
cooling the separated slurry phase;
reducing the pressure of the cooled slurry phase to a pressure near atmospheric;
separating the cooled and depressurized slurry phase into liquid and solid components; and
utilizing a portion of the liquid component as an ingredient of the alkaline aqueous fluid.

16. A process as in claim 13 and including the additional steps of:
cooling the separated second reaction zone slurry phase;
reducing the pressure of the cooled slurry phase to a pressure near atmospheric;
separating the cooled and depressurized slurry phase into liquid and solid components; and
utilizing a portion of the liquid component as an ingredient of the alkaline aqueous fluid.

17. A process as in claim 11 and which includes the additional step of:
recycling a portion of the separated slurry phase to the inlet of the elongated reaction zone.

18. A process as in claim 13 and which includes the additional step of:
recycling a portion of the separated second reaction zone slurry phase to the inlet of the first elongated reaction zone.

19. A process as in claim 13 and which includes the additional step of:
recycling a portion of the separated second reaction zone slurry phase to the inlet of the second elongated reaction zone.

20. A process as in claim 1 in which the step of contacting the fuel slurry with air is carried out at a temperature between 550° and 705.4° F. and at a pressure between 1000 and 10,000 pounds per square inch.

* * * * *